US007474870B2

(12) United States Patent
Kim et al.

(10) Patent No.: US 7,474,870 B2
(45) Date of Patent: Jan. 6, 2009

(54) FIXING UNIT, ELECTRO-PHOTOGRAPHIC IMAGE FORMING APPARATUS HAVING THE SAME, AND PRINTING METHOD THEREOF

(75) Inventors: Jin-yoon Kim, Suwon-si (KR); Seock-deock Hong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 82 days.

(21) Appl. No.: 11/584,571

(22) Filed: Oct. 23, 2006

(65) Prior Publication Data

US 2007/0160397 A1 Jul. 12, 2007

(30) Foreign Application Priority Data

Jan. 10, 2006 (KR) ..... 10-2006-0002738

(51) Int. Cl.
*G03G 15/20* (2006.01)

(52) U.S. Cl. ..... 399/322; 399/45; 399/82; 399/341

(58) Field of Classification Search ..... 399/322, 399/45, 67, 68, 82, 320, 328, 331, 341, 406; 219/216; 347/156; 430/124.1, 124.3, 124.5
See application file for complete search history.

(56) References Cited

U.S. PATENT DOCUMENTS 5,893,019 A * 4/1999 Yoda et al. ..... 219/216 X
7,113,716 B2 * 9/2006 Tomatsu ..... 399/67
7,324,773 B2 * 1/2008 Sugiyama ..... 399/45 X
2005/0123330 A1 * 6/2005 Yoshimura et al. ..... 399/328
2006/0133836 A1 * 6/2006 Nakayama ..... 399/68

FOREIGN PATENT DOCUMENTS

| | | | |
|---|---|---|---|
| JP | 04-280280 A | * | 10/1992 |
| JP | 05-037645 | | 2/1993 |
| JP | 05-165357 | | 7/1993 |
| JP | 07-005785 | | 1/1995 |
| JP | 07-005786 | | 1/1995 |
| JP | 09-265243 | | 7/1997 |
| JP | 2002-006670 A | * | 1/2002 |
| KR | 10-0215299 | | 8/1996 |

* cited by examiner

*Primary Examiner*—Sophia S Chen
(74) *Attorney, Agent, or Firm*—Roylance, Abrams, Berdo & Goodman, L.L.P.

(57) ABSTRACT

A fixing unit, an electro-photographic image forming apparatus having the same, and a printing method thereof are provided. The electro-photographic image forming apparatus includes a printing unit that forms a toner image on a recording medium by an electro-photographic method, a heat roller, a first pressure roller that faces the heat roller and forms a first fixing nip therebetween, one or more second pressure rollers that face the heat roller and form a second fixing nip therebetween, and a guide member that changes its position to a first position for guiding the recoding medium to the second fixing nip after the recording medium passes through the first fixing nip or to a second position for blocking the recording medium from moving to the second fixing nip after the recording medium passes through the first fixing nip.

26 Claims, 6 Drawing Sheets

FIXING UNIT, ELECTRO-PHOTOGRAPHIC IMAGE FORMING APPARATUS HAVING THE SAME, AND PRINTING METHOD THEREOF

CROSS-REFERENCE TO RELATED PATENT APPLICATION

This application claims the benefit under 35 U.S.C. § 119 (a) of Korean Patent Application No. 10-2006-0002738, filed on Jan. 10, 2006, in the Korean Intellectual Property Office, the entire disclosure of which is hereby incorporated by reference.

BACKGROUND OF THE INVENTION

1. Field of the Invention

The present invention relates to a fixing unit that fixes a transferred toner image on a recording medium by applying heat and pressure, an electro-photographic image forming apparatus having the same, and a printing method thereof.

2. Description of the Related Art

Generally, electro-photographic image forming apparatuses irradiate light on an equipotentially charged photoconductor to form an electrostatic latent image thereon. The electrostatic latent image is developed with toner having a particular color to form a toner image. The toner image is transferred onto a recording media directly or via an intermediate transfer belt. The toner image transferred onto the recording medium adheres to the recording medium by an electrostatic force. The toner image is permanently fixed on the recording medium after a fixing unit applies heat and pressure thereto.

The fixing unit includes a heat roller and a pressure roller. The two rollers are engaged with each other and form a fixing nip therebetween. When the heat and pressure are applied to the recording medium while the recording medium passes through the fixing nip, the toner starts to melt, thereby becoming fixed on the recording medium. The toner image on the recording medium comes in contact with the heat roller. The toner melted in the process of fixing tends to adhere on the surface of the heat roller, in addition to the recording medium. When a stiffness of the recording medium is large enough to get over an adhesive force between the toner and the heat roller, the recording medium is not wound around the heat roller. Otherwise, the recording medium is wound around the heat roller, and thus a paper jam occurs. To prevent this, a separation claw is provided. The separation claw comes in contact with the surface of the heat roller. A front end of the recording medium is separated from the heat roller when it is snagged by the separation claw. The surface of the heat roller may be damaged by the separation claw, because the separation claw continuously contacts the heat roller.

The stiffness of the recording medium varies depending on the property of the recording medium. The property may be a thickness, or a texture orientation of a paper recording medium. When a thick recording medium is used, the recording medium is easily separated from the heat roller due to its large stiffness, but the fixing property is not good because of poor heat transfer. When a thin recording medium is used, or the texture orientation of the recording medium is arranged crosswise, the stiffness is small, and thus the recording medium is likely to be wound around the heat roller. Additionally, an image is differently fixed to or separated from the recording medium depending on an image density.

Accordingly, a need exists for an image forming apparatus having an improved fixing unit that improves fixing an image onto a recording medium and substantially prevents the recording medium from adhering to the fixing unit.

SUMMARY OF THE INVENTION

The present invention provides a fixing unit that optimizes the fixing property and the separation property by taking the type of a recording medium and an image density into account, an electro-photographic image forming apparatus having the same, and a printing method thereof.

According to an aspect of the present invention, a fixing unit fixes a toner image transferred onto a recording medium by applying heat and pressure to the toner image, and comprises a heat roller including a heater, a first pressure roller that faces the heat roller and forms a first fixing nip therebetween, one or more second pressure rollers that face the heat roller and form a second fixing nip therebetween, a guide member that is disposed between the first and second fixing nips, and a driving unit that changes the position of the guide member to a first position for guiding the recoding medium to the second fixing nip after the recording medium passes through the first fixing nip and to a second position for blocking the recording medium from moving to the second fixing nip after the recording medium passes through the first fixing nip.

According to another aspect of the present invention, an electro-photographic image forming apparatus comprises a printing unit that forms a toner image on a recording medium by an electro-photographic method, a heat roller, a first pressure roller that faces the heat roller and forms a first fixing nip therebetween, one or more second pressure rollers that face the heat roller and form a second fixing nip therebetween, and a guide member that changes its position to a first position for guiding the recoding medium to the second fixing nip after the recording medium passes through the first fixing nip or to a second position for blocking the recording medium from moving to the second fixing nip after the recording medium passes through the first fixing nip.

In the aforementioned aspects of the apparatus, surface rigidities of the heat roller, the first pressure roller, and the second pressure roller may be related to $Hpr1<Hhr<Hpr2$, where the surface rigidities of the heat roller, the first pressure roller, and the second pressure roller are Hhr, Hpr1, and Hpr2, respectively.

Additionally, the apparatus may further comprise a driving unit that separates the second pressure roller from the heat roller when the guide member is positioned at the second position.

Additionally, the printing unit may be a color printing unit that superimposedly transfers cyan, magenta, yellow, and black toner onto the recording medium.

According to another aspect of the present invention, a printing method of an electro-photographic image forming apparatus transfers a toner image of one or more colors onto a recording medium by an electro-photographic method and fixes the toner image on the recording medium by applying heat and pressure using a fixing unit that includes a heat roller, a first pressure roller facing the heat roller and forming a first fixing nip therebetween, and one or more second pressure rollers facing the heat roller and forming a second fixing nip therebetween. A first fixing mode allows the recording medium that is discharged from the printing unit to sequentially pass through the first and second fixing nips. A second fixing mode allows the recording medium to pass through the first fixing nip only. The first and second fixing modes are selectively used according to the type of the recording medium and an image density.

In the aforementioned aspect of the method, the second fixing mode may be used when the recoding medium is an envelope.

Additionally, when the recording medium is a thin recording medium whose basis weight is less than a plain paper sheet or a crosswise paper sheet and the image density is higher than an normal density, the first fixing mode may be used. When the recording medium is a thin recording medium whose basis weight is less than the plain paper sheet or the crosswise paper sheet and the image density is lower than a normal density, the second fixing mode may be used.

Additionally, when the basis weight of the recording medium is equal to or greater than the basis weight of the plain paper sheet, the first fixing mode may be used regardless of the image density.

Additionally, the type of the recording medium may be input through a user interface element.

Additionally, the image density may be detected using a method selected from a method of detecting an image density from a toner image on an intermediate transfer belt, a method of detecting an image density by counting the number of pixels of a printing image, and a method of detecting an image density from coverage of the toner image printed on the recording medium.

Objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Hereinafter, the present invention is described in detail by explaining exemplary embodiments of the invention with reference to the attached drawings.

Figure 1:
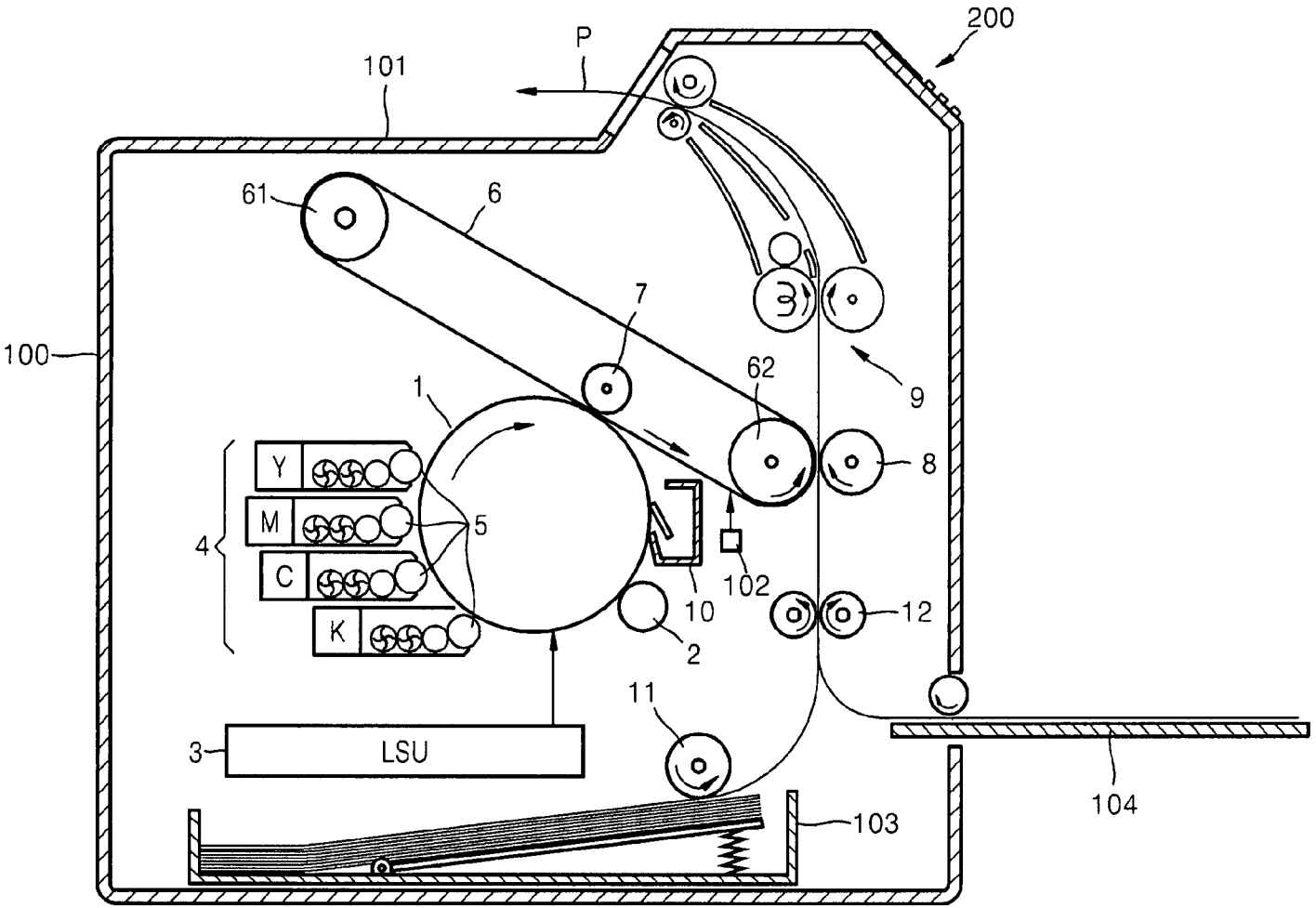
FIG. 1 is a schematic view of an electro-photographic image forming apparatus according to an exemplary embodiment of the present invention.

FIG. 1 is a schematic view of a structure of an electro-photographic image forming apparatus according to an exemplary embodiment of the present invention. Referring to FIG. 1, the image forming apparatus includes a printing unit 100 that transfers a toner image onto a recording medium P by an electro-photographic method and a fixing unit 9 that fixes the toner image on the recording medium P by applying heat and pressure thereto. The printing unit 100 includes a photosensitive drum 1, a charging roller 2, a light exposing unit 3, a developing unit 4, an intermediate transfer belt 6, a first transfer roller 7, and a second transfer roller 8.

A photosensitive layer (not shown) is formed on the surface of the photosensitive drum 1. A photosensitive belt (not shown) may be used instead of the photosensitive drum 1. The charging roller 2 rotates in contact or non-contact with the surface of the photosensitive drum 1, and supplies electrical charge thereto to equipotentially charge the surface of the photosensitive drum 1. A corona discharger (not shown) may be used instead of the charging roller 2. The light exposing unit 3 irradiates light, which corresponds to image information, on the equipotentially charged photosensitive drum 1 to form an electrostatic latent image. The light exposing unit 3 is preferably a laser scanning unit (LSU) that uses a laser diode as a light source.

The image forming apparatus of the present invention uses cyan C, magenta M, yellow Y, and black K toner to print a color image. Hereinafter, if necessary, elements are distinguished by the affix Y, M, C, or K followed by numeral references thereof.

The image forming apparatus includes four developing units 4Y, 4M, 4C, and 4K that develop a toner image by supplying yellow Y, magenta M, cyan C, and black K toner to the electrostatic latent image formed on the photosensitive drum 1. The developing unit 4 includes a developing roller 5. The developing unit 4 is disposed such that the developing roller 5 is separated from the photosensitive drum 1 by a developing gap. The developing gap may be tens to hundreds of microns.

In a multi-pass type image forming apparatus, a plurality of developing units 4 sequentially operate. A developing bias voltage may be applied to a developing roller 5 of a selected developing unit, for example, 4Y. For the rest of the developing units, for example, 4M, 4C, and 4K, the developing bias voltage may not be applied thereto, or an anti-developing bias voltage may be applied thereto to prevent toner from developing. Only the developing roller 5 of the selected developing unit, for example, 4Y, may rotate, and developing rollers 5 of the rest of developing units, for example, 4M, 4C, and 4K, may not rotate.

The intermediate transfer belt 6 is supported by supporting rollers 61 and 62, and travels at substantially the same linear velocity with respect to a rotational linear velocity of the photosensitive drum 1. The length of the intermediate transfer belt 6 may be equal to or greater than that of a maximum size of the recording medium P. The first transfer roller 7 faces the photosensitive drum 1. A first transfer bias voltage is applied to the first transfer roller 7 to transfer the toner image developed onto the photosensitive drum 1 to the intermediate transfer belt 6. The second transfer roller 8 faces the intermediate transfer belt 6. While the toner image is transferred from the photosensitive drum 1 to the intermediate transfer belt 6, the second transfer roller 8 is separated from the intermediate transfer belt 6, and after the toner image is transferred onto the intermediate transfer belt 6, the second transfer roller 8 comes in contact with the intermediate transfer belt 6 by a particular pressure. A second transfer bias voltage is applied to the second transfer roller 8 to transfer the toner image onto the recording medium. A cleaning element 10 removes toner that remains on the photosensitive drum 1 after transferring the toner image to the intermediate belt 6.

Figure 2:
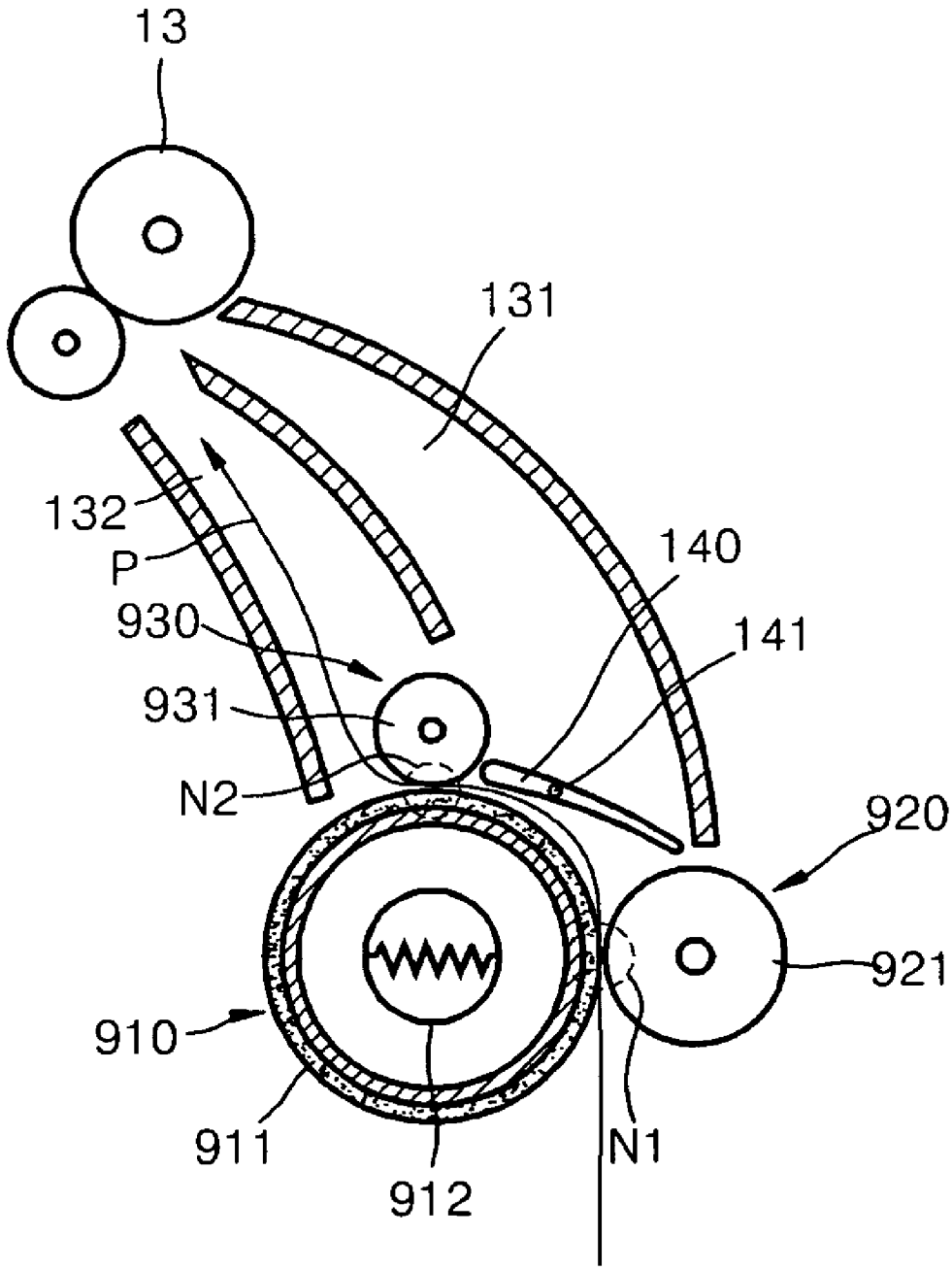
FIG. 2 is an elevational view of a guide member and a second pressure roller when a first fixing mode is used.

Referring to FIGS. 1 and 2, the fixing unit 9 includes a heat roller 910 and first and second pressure rollers 920 and 930. The heat roller 910 preferably has a hollow pipe-shape and has a heater 912 inside thereof. The first pressure roller 920 contacts the heat roller 910 and forms a first fixing nip N1 therebetween. To form the first fixing nip N1, an outermost layer 911 of the heat roller 910 and/or an outermost layer 921 of the first pressure roller 920 may be an elastic layer. In this exemplary embodiment of the present invention, the outermost layer 911 of the heat roller 910 and the outermost layer 921 of the first pressure roller 920 are elastic layers. The elastic layer may be a silicon rubber layer. The second pressure roller 930 faces the heat roller 910 and forms a second fixing nip N2 therebetween. To form the second fixing nip N2, when the outermost layer 911 of the heat roller 910 is a rigid body, an outermost layer 931 of the second pressure roller 930 may be an elastic layer, and when the outermost layer 911 of the heat roller 910 is an elastic layer, the outermost layer 931 of the second pressure roller 930 may be an elastic layer or a rigid body. To improve a separation property, rigidities of the two layers 911 and 931 may be related as Hhr<Hpr2, where rigidities of the outermost layers 911 of the heat roller 910 and the outermost layer 931 of the second pressure roller 930 are Hhr and Hpr2, respectively. Additionally, to easily guide the recording medium P to the second fixing nip N2 after the recording medium P passes through the first fixing nip N1, rigidities of the two layers 921 and 911 may be related as Hpr 1<Hhr , where a rigidity of the outermost layer 921 of the first pressure roller 920 is Hpr1. Consequently, the rigidities of the outermost layer 911 of the heat roller 910, the outermost layer 921 of the first pressure rollers 920, and the outermost layer 931 of the second pressure roller 930 are related as Hpr1<Hhr<Hpr2. The image forming apparatus of this exemplary embodiment uses one second pressure roller 930 only, but two or more second pressure rollers 930 may be used if necessary.

To guide the recording medium P to a discharging unit 13 when the recording medium P is discharged from the fixing unit 9, the image forming apparatus includes first and second discharging paths 131 and 132. The first discharging path 131 connects the first fixing nip N1 and the discharging unit 13. The second discharging path 132 connects the second fixing nip N2 and the discharging unit 13. A guide member 140 is disposed between the first and second fixing nips N1 and N2. The guide member 140 may change its position from a first position (see FIG. 2), which guides the recording medium P towards the second fixing nip N2 after the recording medium P passes through the first fixing nip N1, to a second position (see FIG. 3) which blocks the recording medium P from moving towards the second fixing nip N2 after the recording medium P passes through the first fixing nip N1. For this, the guide member 140 rotates about a rotation axis 141. When the guide member 140 is positioned at the second position, the second pressure roller 930 may be separated from the heat roller 910. By doing so, a driving unit for driving the fixing unit 9 has less of a load, and the heat roller 910 and the second pressure roller 930 are less likely to be worn out.

Figure 4:
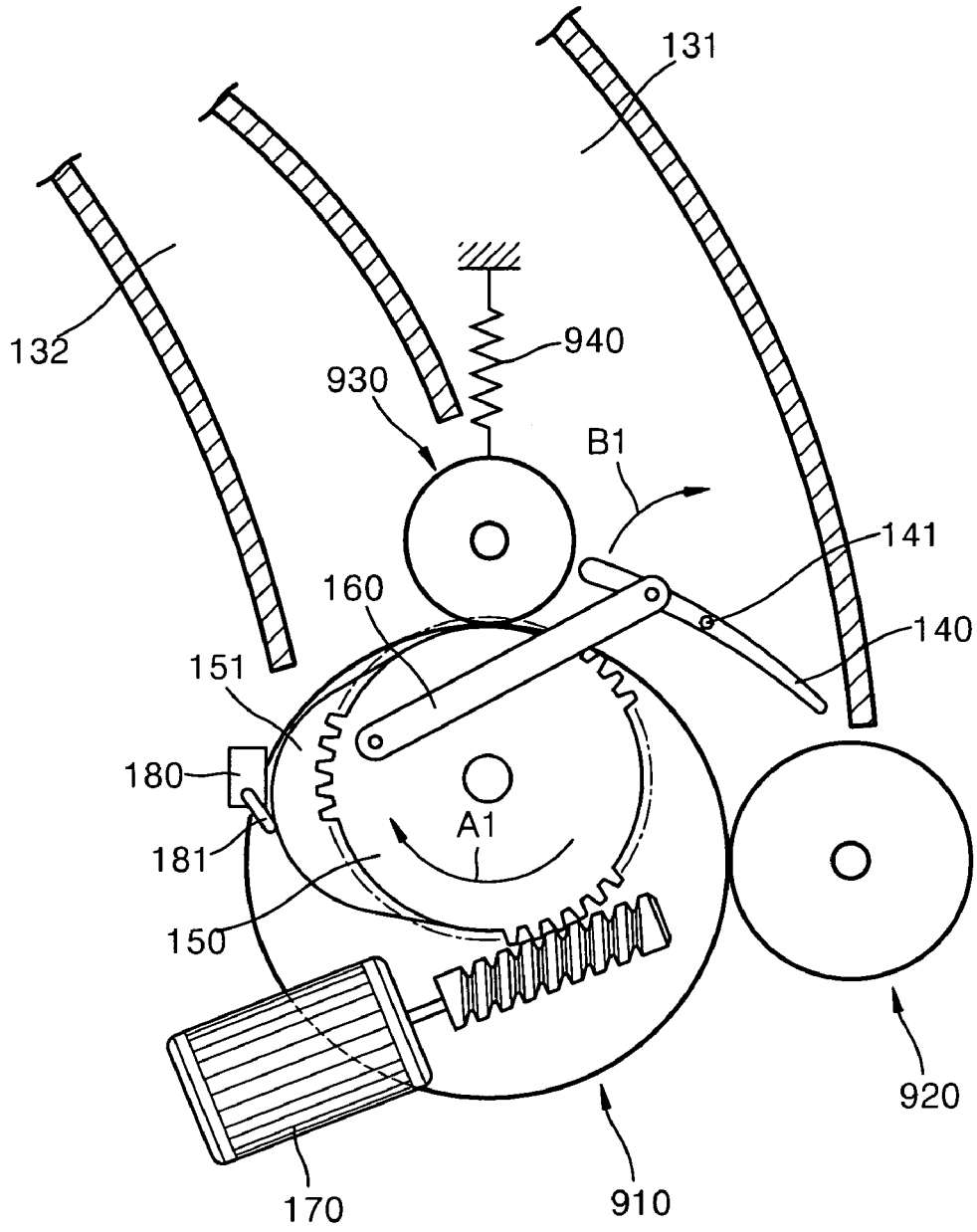
FIGS. 4 and 5 are elevational views of a driving unit according to an exemplary embodiment of the present invention.
Figure 5:
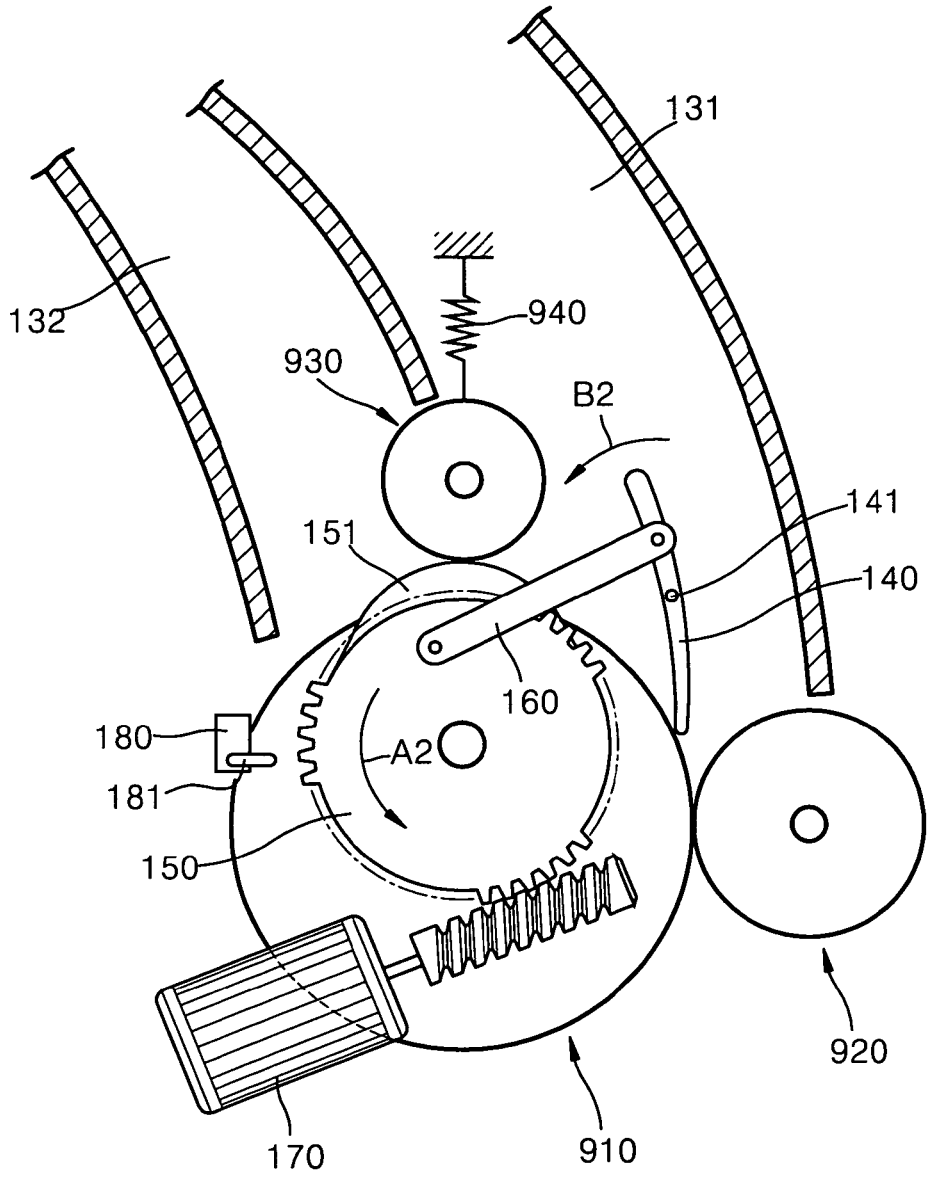

FIG. 4 shows a driving unit that changes the position of the guide member 140 to the first or second positions and contacts or separates the second pressure roller 930 to or from the heat roller 910. Referring to FIG. 4, the driving unit includes a cam member 150 that is rotated by a driving motor 170. A first end of a connecting arm 160 is rotatably connected to the cam member 150 and a second end of the connecting arm is connected to the guide member 140. A spring 940 pushes the second pressure roller 930 towards the heat roller 910. The guide member 140 is positioned at the first position to guide the recording medium P towards the second fixing nip N2. In this condition, when the driving motor 170 rotates the cam member 150 in a direction Al, a cam trace 151 of the cam member 150 pushes the second pressure roller 930, and thus the second pressure roller 930 is separated from the heat roller 910. Also, the connecting arm 160 pushes the guide member 140. Then, the guide member 140 rotates about the rotation axis 141 in a direction B1, and is positioned at the second position of FIG. 5 to block the recording medium P from moving towards the second fixing nip N2. In the condition as shown in FIG. 5, when the cam member 150 is rotated in a direction A2 by the driving motor 170, the second pressure roller 930 contacts the heat roller 910 by an elastic force of the spring 940. Also, the connecting arm 160 pulls the guide member 140. The guide member 140 rotates in a direction B2, and returns to the first position shown in FIG. 4. A micro-switch 180 detects the cam trace 151. For example, when the guide member 140 is positioned at the first position, the cam trace 151 pushes a lever 181 as shown in FIG. 4, and thus an "ON" signal is output from the micro-switch 180. When the guide member 140 is positioned at the second position, the cam trace 151 is separated from the lever 181 as shown in FIG. 5, and thus an "OFF" signal is output from the micro-switch 180. The micro-switch 180 is only an example of a sensing element for detecting positions of the guide member 140 and the second pressure roller 930, and the exemplary embodiments of the present invention are not limited thereto. Instead of the micro-switch 180, various sensing elements may be used, such as an optical sensor.

A printing method of the aforementioned image forming apparatus is described below.

A light corresponding to information on a yellow Y image, for example, is irradiated from the light exposing unit 3 to the photosensitive drum 1, which is equipotentially charged by the charging roller 2. An electrostatic latent image corresponding to the yellow Y image is formed on the photosensitive drum 1. A developing bias voltage is applied to the developing roller 5 of the yellow Y developing unit 4Y. Then, yellow Y toner adheres to the electrostatic latent image, and thus a yellow Y toner image is developed onto the photosensitive drum 1. The yellow Y toner image is transferred onto the intermediate transfer belt 6 by the first transfer bias voltage applied to the first transfer roller 7. After the yellow Y toner image is transferred onto a sheet of paper, the light exposing unit 2 irradiates a light corresponding to information on a magenta M image onto the photosensitive drum 1 that is equipotentially charged by the charging roller 2, and forms an electrostatic latent image corresponding to the magenta M image. The magenta developing unit 4M develops the magenta M image by supplying magenta M toner to the electrostatic latent image. The magenta M toner image formed on the photosensitive drum 1 is transferred onto the intermediate transfer belt 6, so that the magenta M toner image is superimposed on the yellow Y toner image. Likewise, the aforementioned process is repeated with respect to the cyan C and black K, then yellow Y, magenta M, cyan C, and black K toner images are superimposely transferred onto the intermediate transfer belt 6, thereby forming a color toner image. The second transfer roller 8 contacts the intermediate transfer belt 6. A pickup roller 11 picks up the recording medium P from a feeding cassette 103. A conveying unit 12 conveys the recording medium P to a transfer nip where the intermediate transfer belt 6 and the second transfer roller 8 face with each other. The color toner image is transferred onto the recording medium P passing through the transfer nip by the second transfer bias voltage.

The recording medium P enters the fixing unit 9. A feature of the printing method of the exemplary embodiment is to selectively use first and second fixing modes according to the type of the recording medium P and an image density. When the first fixing mode is used, the recording medium P sequentially passes through the first and second fixing nips N1 and N2, and then is discharged by the discharging unit 13. When the second fixing mode is used, the recording medium P passes through the first fixing nip N1 only, and is then discharged by the discharging unit 13.

Figure 6:
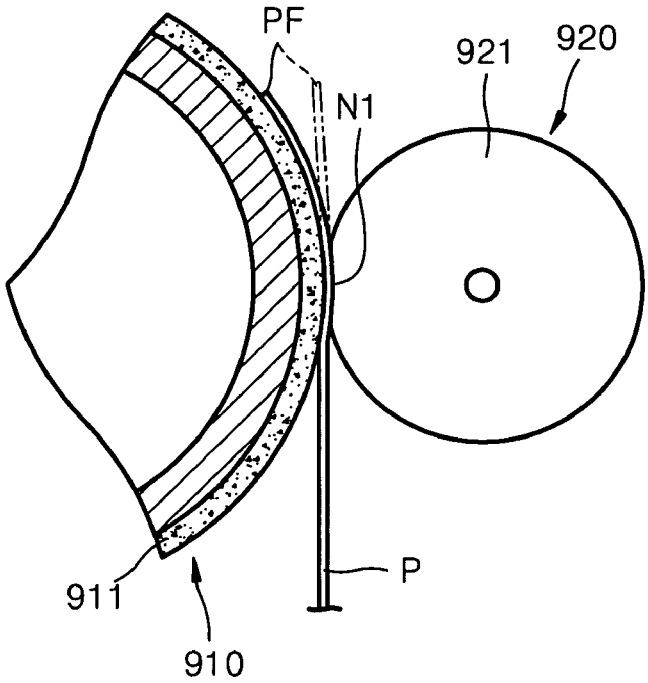
FIG. 6 is an elevational view illustrating a recording medium passing through a first fixing nip.
Figure 7:
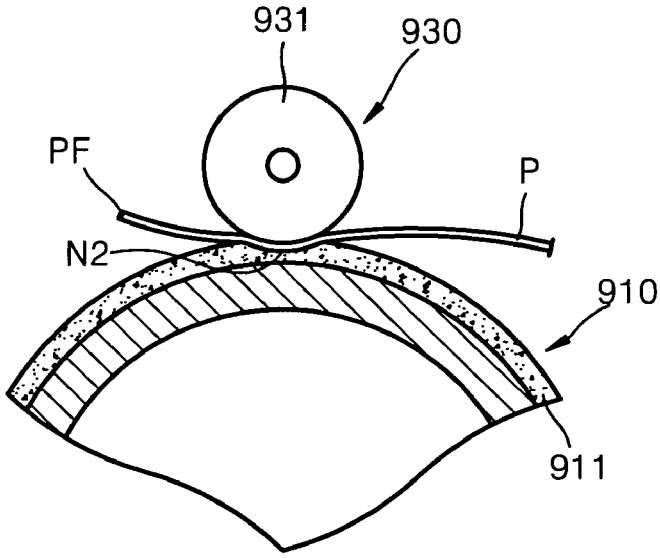
FIG. 7 is an elevational view illustrating a recording medium passing through a second fixing nip.

Various recording mediums P are used for an image receptor for storing images permanently. The property of the recording mediums P has an influence on a fixing property and a separation property. The fixing property means how effectively the toner image is fixed on the recording medium P. The separation property means how well the recording medium P is separated from the heat roller 910 without being wounded around the heat roller 910. Also, the image density has an influence on the fixing property and the separation property. To improve the fixing property by combining the property of the recording medium P and the image density, the fixing nip needs to be long. For this reason, the first fixing mode is preferably used. The first fixing nip N1 has a convex curve at the first pressure roller 920, as shown in FIG. 6. This is because the outermost layer 911 of the heat roller 910 has a greater rigidity than the outermost layer 921 of the first pressure roller 920. For this reason, a front end PF of the recording medium P is bent towards the heat roller 910 after the recording medium P passes through the first fixing nip N1. On the other hand, because the outermost layer 911 of the heat roller 910 has a smaller rigidity than the outermost layer 931 of the second pressure roller 930, the second fixing nip N2 has a convex curve at the heat roller 910, as shown in FIG. 7. For this reason, the front end PF of the recording medium P is bent in a direction that the recording medium P is separated from the heat roller 910, after the recording medium P passes through the second fixing nip N2. Given this, it is also preferable to use the first fixing mode when the separation property needs to be improved by combining the property of the recording medium P and the image density.

The type of the recording medium P may be input through an input element 200 included in the image forming apparatus or through a user interface of a driver program executed in a host computer. Although not shown, the input element 200 includes an input button for inputting information and a display unit for visually checking the input information. A density sensor 102 detects an image density from a toner image on the intermediate transfer belt 6. The image density may be detected by counting the number of pixels of a printing image. The image density may be represented by coverage. For example, if monochrome toner is transferred onto overall area of the recording medium P, coverage is 100%. Thus, when a monochrome image is printed, its coverage does not exceed 100%. If yellow, cyan, magenta, and black toner are transferred onto an overall area of the recording medium P, its coverage is 400%, since 100% of yellow, cyan, magenta, and black toner is respectively transferred. In this case, however, areas where yellow, cyan, and magenta toner are superimposed are replaced to black. Thus, the maximum coverage is about 200% when a color image is printed in practice. When coverage is 100%, optical density is 0.9. When coverage of yellow, cyan, magenta, and black are 10%, 20%, 30%, and 40%, respectively, coverage is 100%.

The recording medium P is classified into a plain paper sheet and a thin paper sheet according to its basis weight. The recording medium P whose basis weight is about 75~100 $g/m^2$ is called the plain paper sheet. The recording medium P whose basis weight is less than the plain paper sheet is called the thin paper sheet. Although it is different depending on manufacturers, the basis weight of the thin paper sheet is normally about 60~70 $g/m^2$.

When the toner image passes through the first fixing nip N1, its viscosity increases by heat, and thus the toner image tends to adhere to the recording medium P and the heat roller 910. When the stiffness of the recording medium P is greater than the adhesive property of the toner image with respect to the heat roller 910, the recording medium P is easily separated from the heat roller 910. When the plain paper sheet is used, the front end PF of the recording medium P is bent towards the heat roller 910 according to the shape of the first fixing nip N1, but is separated from the heat roller 910 by the restoring force, as indicated by a dotted line in FIG. 6. Therefore, when the plain paper sheet is used, the second fixing mode may be used considering the separation property. The plain paper sheet absorbs heat due to its thickness. For this reason, heat has to be sufficiently applied to the toner image to improve its fixing property. Furthermore, when a color image is printed, more toner is required then when printing a monochrome image, and thus sufficient heat has to be applied to the toner image. According to the printing method of this exemplary embodiment, the separation property and the fixing property of the recording medium P are taken into account, and if the recording medium P is the plain paper sheet, the first fixing mode is used regardless of whether the image density is high or low. After passing through the second fixing nip N2, the recording medium P has a better separation property because the front end PF of the recording medium P is bent in a direction such that the recording medium P is separated from the heat roller 910.

The thin paper sheet absorbs less heat, and thus its separation property is not good due to its poor stiffness even though its fixing property is generally good. A texture orientation of the recording medium P also has a significant influence on the separation property. Generally, the recording medium P is made by laminating its texture in lengthwise and crosswise alternately. Thus, it is not necessary to consider the texture orientation. However, sometimes the texture orientation of the recording medium P is arranged crosswise. The recording medium P of which texture orientation is arranged crosswise (hereinafter referred to as a crosswise paper sheet) has a poor separation property because its stiffness is very low. When the recording medium P is the thin paper sheet or the crosswise paper sheet, the adhesive strength of the toner image with respect to the heat roller 910 has to be taken into account, which is influenced by the image density. When the image density is high, the amount of toner is large, and thus the adhesive strength of the toner image with respect to the heat roller 910 increases as a result thereof. When the recording medium P is the thin paper sheet or the crosswise paper sheet, and the image density is lower than a normal density, then the second fixing mode is used. This is because the recording medium P may be separated from the heat roller 910 due to the stiffness of the recording medium P. When the image density is greater than the normal density, the adhesive strength of the toner image with respect to the heat roller 910 is great, and thus the toner image is not easily separated from the heat roller 910 by the stiffness of the recording medium P. For this reason, the first fixing mode is used in this case. As described above, when a monochrome image is printed, its coverage does not exceed 100%. A document that does not contain a graphic image, such as a photograph, has coverage of about 15%. To determine which level of image density has an influence on the separation property of the recording medium P, viscosity of the toner should be considered. In this exemplary embodiment of the present invention, the normal density is set to 0~100%, which corresponds to an optical density of 0~0.9. Generally, when a color image is printed, its coverage may exceed 100%. The normal density to be used to determine whether to use the first fixing mode or the second fixing mode is not limited thereto, and it may be determined through experiment by taking the property of the toner and the separation property of the heat roller 910 into account.

The recording medium P may be an envelope. Generally, the envelope is supplied from a multi-purpose tray 104 (FIG. 1) for loading non-standard paper sheets. The envelope is easily crumpled or creased in a fixing process. Thus, the length of the fixing nip is preferably as short as possible. For this reason, when the recording medium P is the envelope, the second fixing mode (FIG. 3) is used. Because relatively small image sizes are printed on the envelope, there is no problem with the fixing property when the second fixing mode is used, and its separation property is good due to its large stiffness. Furthermore, to improve the fixing property, a fixing temperature may be set to be higher then when using the plain paper sheet or the thin paper sheet. Additionally, a fixing speed, that is, a speed for conveying the envelope, may be reduced to sufficiently transfer heat of the heat roller 910 to the toner image.

Figure 3:
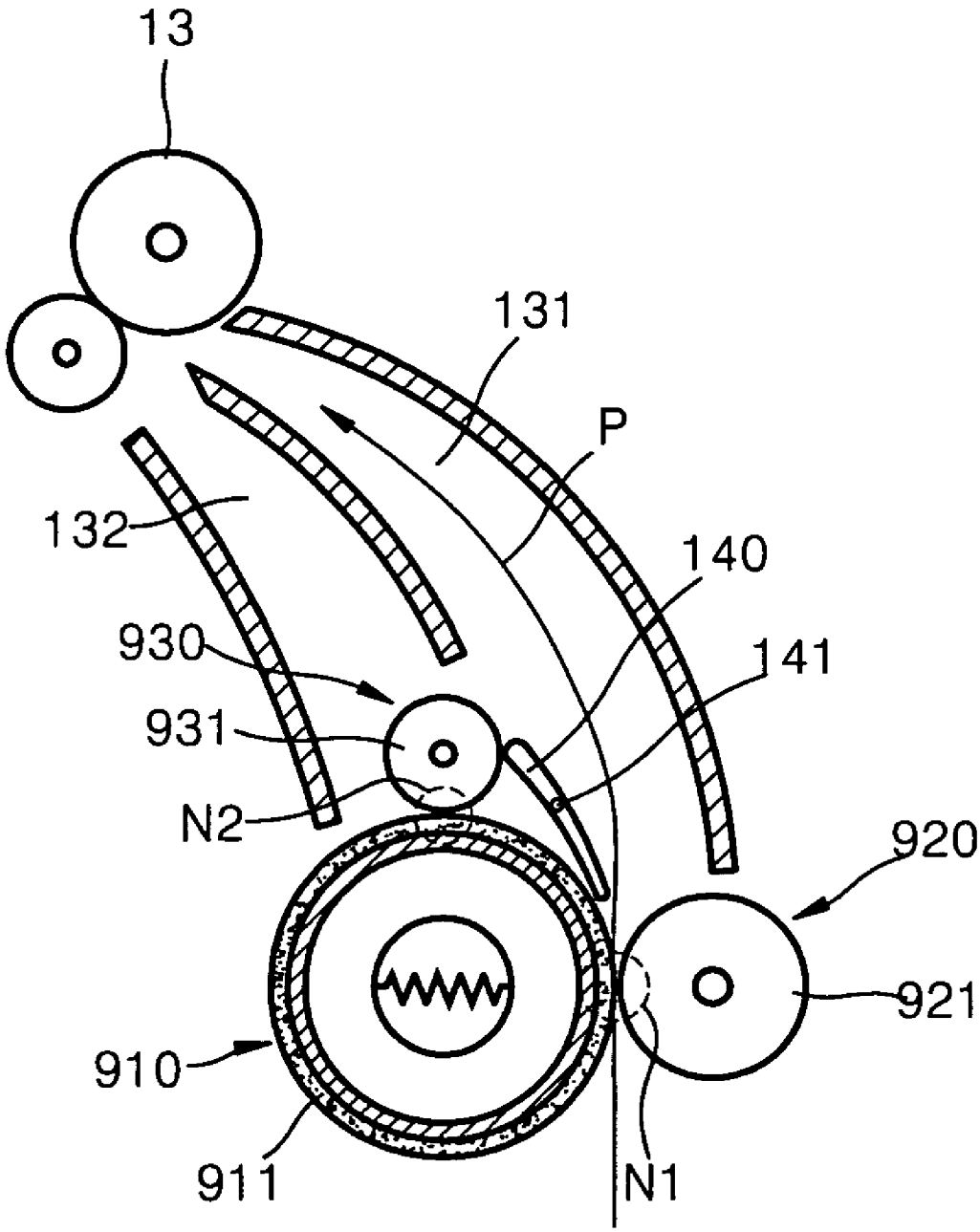
FIG. 3 is an elevational view of a guide member and a second pressure roller when a second fixing mode is used.

Through the aforementioned process, it is determined which fixing mode will be used according to the property of the recording medium P and the image density. For example, if the first fixing mode is used, the output of the micro-switch 180 is checked. When the output of the micro-switch 180 is ON, as shown in FIGS. 2 and 4, the guide member 140 is positioned at the first position, and the second pressure roller 930 contacts the heat roller 910, thereby forming the second fixing nip N2. Thus, printing is carried out in the first fixing mode without having to drive the driving unit. When the output of the micro-switch 180 is OFF, as shown in FIGS. 3 and 5, the guide member 140 is positioned at the second position, and the second pressure roller 930 is separated from the heat roller 910. When the cam member 150 is rotated by the driving motor 170 in the direction A2, as shown in FIGS. 2 and 4, the guide member 140 rotates about the rotation axis 141 in the direction B2, and is positioned at the first position. Additionally, the cam trace 151 is separated from the second pressure roller 930, and the second pressure roller 930 contacts the heat roller 910 by the elastic force of the spring 940. When the output of the micro-switch 180 changes to ON, the driving motor 170 is stopped. In this state, printing is carried out in the first fixing mode. After the recording medium P passes through the first and second fixing nips N1 and N2, the recording medium P is discharged to the discharging tray 101 through the second discharging path 132.

When the second fixing mode is used, the cam member 150 is rotated by the driving motor 170 in the direction A1. Then, the guide member 140 rotates about the rotation axis 141 in the direction B1, and is positioned at the second position. At this time, one end of the guide member 140 contacts the surface of the heat roller 910 or is disposed near the heat roller 910 to function as the separation claw. Additionally, the cam trace 151 pushes the second pressure roller 930 to separate the second pressure roller 930 from the heat roller 910. The output of the micro-switch 180 changes to OFF. In this state, printing is carried out in the second fixing mode. After the recording medium P passes through the first second fixing nip N1, the recording medium P is discharged to the discharging tray 101 through the first discharging path 131.

In the aforementioned exemplary embodiment of the present invention, a multi-pass type color image forming apparatus includes one photosensitive drum 1, one light exposing unit 3, and four developing units 4. Although not shown, the present invention may be used for a single-pass type color image forming apparatus including four photoconductors 1, four light exposing units 3, and four developing units 4. Also, the present invention may be used for a monochrome electro-photographic image forming apparatus.

According to a fixing unit, an electro-phtographic image forming apparatus, and a printing method thereof, a fixing property and a separation property may be secured by using different fixing modes based on a property of a recording medium and an image density. Additionally, a second pressure roller may selectively contact a heat roller based on the fixing modes. Thus, the surface of the heat roller is less damaged, and the image forming apparatus may have increased durability.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. An electro-photographic image forming apparatus, comprising:

a printing unit that forms a toner image on a recording medium by an electro-photographic method;

a heat roller;

a first pressure roller that faces the heat roller and forms a first fixing nip therebetween;

at least one second pressure roller that is separated from the heat roller and faces the heat roller to form a second fixing nip therebetween;

a guide member movable between a first position that guides the recoding medium to the second fixing nip after the recording medium passes through the first fixing nip and a second position that blocks the recording medium from moving to the second fixing nip after the recording medium passes through the first fixing nip; and a sensing member detecting the position of the guide member and the at least one second roller.

2. The apparatus of claim 1, wherein surface rigidities of the heat roller, the first pressure roller, and the at least one second pressure roller are different such that Hpr1<Hhr<Hpr2, where the surface rigidities of the heat roller, the first pressure roller, and the at least one second pressure roller are Hhr, Hprl, and Hpr2, respectively.

3. The apparatus of claim 1, further comprising a driving unit that separates the at least one second pressure roller from the heat roller when the guide member is positioned at the second position.

4. The apparatus of claim 1, wherein the printing unit is a color printing unit that superimposedly transfers cyan, magenta, yellow, and black toner onto the recording medium.

5. The apparatus of claim 4, wherein the guide member separates the recording medium from the heat roller when positioned at the second position.

6. The apparatus of claim 1, wherein the sensing member is a micro-switch.

7. The apparatus of claim 6, wherein a cam member is connected to the guide member that engages the micro-switch when the guide member is in the first position.

8. A method of printing for an electro-photographic image forming apparatus, comprising the steps of transferring a toner image of one or more colors onto a recording medium by an electro-photographic method in a printing unit;

fixing the toner image on the recording medium by applying heat and pressure using a fixing unit that includes a heat roller, a first pressure roller facing the heat roller and forming a first fixing nip therebetween, at least one second pressure roller being separated from the heat roller and facing the heat roller to form a second fixing nip therebetween. and a guide member movable between a first position that guides the recording medium to the second fixing nip after the recording medium passes through the first fixing nip and a second position that blocks the recording medium from moving to the second fixing nip after the recording medium passes through the first fixing nip;

detecting the position of the guide member and the at least one second pressure roller; and operating the image forming apparatus in a first or second fixing mode, wherein the first fixing mode sequentially passes the recording medium discharged from the printing unit through the first and second fixing nips, and the second fixing mode passes the recording medium discharged from the printing unit only through the first fixing nip.

9. The method of claim 8, wherein operating in the first or second fixing mode is determined according to a type of recording medium used and an image density.

10. The method of claim 9, wherein the second fixing mode is used when the recoding medium is an envelope.

11. The method of claim 9, wherein when the recording medium is a thin recording medium whose basis weight is less than a plain paper sheet or a crosswise paper sheet and the image density is higher than a normal density, the first fixing mode is used, and when the recording medium is a thin recording medium whose basis weight is less than a plain paper sheet or a crosswise paper sheet and the image density is lower than a normal density, the second fixing mode is used.

12. The method of claim 9, wherein when a basis weight of the recording medium is equal to or greater than a basis weight of a plain paper sheet, the first fixing mode is used regardless of the image density.

13. The method of claim 9, wherein the type of recording medium is input through a user interface element.

14. The method of claim 9, wherein the image density is detected using a method selected from a method of detecting an image density from a toner image on an intermediate transfer belt, a method of detecting an image density by counting the number of pixels of a printing image, and a method of detecting an image density from coverage of the toner image printed on the recording medium.

15. The method of claim 8, wherein when the second fixing mode is used, the second pressure roller is separated from the heat roller.

16. A fixing unit that fixes a toner image transferred onto a recording medium by applying heat and pressure to the toner image, comprising:

a heat roller including a heater;

a first pressure roller that faces the heat roller and forms a first fixing nip therebetween;

at least one second pressure roller that is separated from the heat roller and faces the heat roller to form a second fixing nip therebetween;

a guide member that is disposed between the first and second fixing nips;

a driving unit that moves the guide member between first and second positions; and a sensing member detecting the position of the guide member and the at least one second roller, wherein the first position guides the recoding medium to the second fixing nip after the recording medium passes through the first fixing nip, and the second position blocks the recording medium from moving to the second fixing nip after the recording medium passes through the first fixing nip.

17. The fixing unit of claim 16, wherein the driving unit separates the second pressure roller from the heat roller when the guide member is positioned at the second position.

18. The fixing unit of claim 16, wherein surface rigidities of the heat roller, the first pressure roller, and the at least one second pressure roller are different such that Hpr1<Hhr<Hpr2, where the surface rigidities of the heat roller, the first pressure roller, and the at least one second pressure roller are Hhr, Hprl, and Hpr2, respectively.

19. A fixing unit for an image forming apparatus, comprising:

a heat roller including a heater;

a first pressure roller facing the heat roller and forming a first fix nip therebetween;

at least one second pressure roller separated from the heat roller and facing the heat roller to form a second fixing nip therebetween;

a guide member disposed between the first and second fixing nips;

a cam member connected to the guide member;

a driving unit connected to the cam member to move the guide member between first and second positions; and a sensing member detecting the position of the guide member and the at least one second roller, wherein the first postion guides the recoding medium to the second fixing nip after the recording medium passes through the first fixing nip, and the second position blocks the recording medium from moving to the second fixing nip agter the recording medium passes through the first fixing nip.

20. The apparatus of claim 19, wherein surface rigidities of the heat roller, the first pressure roller, and the at least one second pressure roller are different.

21. The apparatus of claim 20, wherein the surface rigidities are such that Hpr1<Hhr<Hpr2, where the surface rigidities of the heat roller, the first pressure roller, and the at least one second pressure roller are Hhr, Hprl, and Hpr2, respectively.

22. The apparatus of claim 19, wherein the cam member separates the at least one second pressure roller from the heat roller when the guide member is in the second position.

23. The apparatus of claim 19, wherein the fixing unit is disposed in a color printing unit that superimposedly transfers cyan, magenta, yellow, and black toner onto the recording medium.

24. The apparatus of claim 23, wherein the guide member separates the recording medium from the heat roller when the guide member is in the second position.

25. The apparatus of claim 19, wherein the sensing member is a micro-switch.

26. The apparatus of claim 25, wherein the cam member moves the micro-switch between on and off positions depending on whether the guide member is in the first or second position.

* * * * *